US006439326B1

(12) United States Patent
Huang et al.

(10) Patent No.: US 6,439,326 B1
(45) Date of Patent: Aug. 27, 2002

(54) CENTERED-LEG ROLLER CONE DRILL BIT

(75) Inventors: Sujian Huang; Chris E. Cawthorne, both of The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/546,476

(22) Filed: Apr. 10, 2000

(51) Int. Cl.[7] ..... E21B 10/08
(52) U.S. Cl. ..... 175/334; 175/343; 175/376
(58) Field of Search ..... 175/334, 336, 175/355, 356, 376, 385, 386, 391, 398, 343

(56) References Cited

U.S. PATENT DOCUMENTS

| | | | | |
|---|---|---|---|---|
| 1,322,540 A | | 11/1919 | Chapman | |
| 1,758,773 A | | 5/1930 | Zublin | |
| 1,821,474 A | * | 9/1931 | Mercer | 175/334 X |
| 2,025,261 A | * | 12/1935 | Zublin | 175/334 X |
| 2,119,618 A | | 6/1938 | Zublin | |
| 2,151,544 A | | 3/1939 | Zublin | |
| 2,151,545 A | | 3/1939 | Zublin | |
| 2,227,210 A | | 12/1940 | Zublin | |
| 2,335,929 A | | 12/1943 | Fortune | |
| 2,375,335 A | * | 5/1945 | Walker | 175/334 X |
| 2,598,518 A | | 5/1952 | Dufilho | |
| 3,424,258 A | | 1/1969 | Nakayama | |
| 3,429,390 A | | 2/1969 | Bennett | |
| 4,031,974 A | * | 6/1977 | Peterson | 175/334 |
| 4,140,189 A | | 2/1979 | Garner | |
| 4,936,398 A | * | 6/1990 | Auty et al. | 175/336 |
| 5,415,243 A | | 5/1995 | Lyon et al. | |
| 6,119,797 A | * | 9/2000 | Hong et al. | 175/336 |
| 6,167,975 B1 | * | 1/2001 | Estes | 175/376 X |

FOREIGN PATENT DOCUMENTS

| | | | |
|---|---|---|---|
| FR | 2648862 A | * | 12/1990 |
| GB | 2 027 772 A | | 2/1980 |
| GB | 2 310 443 A | | 8/1997 |
| GB | 2203774 A | | 10/1998 |

OTHER PUBLICATIONS

Great Britain search report dated Jun. 12, 2001, 1 page.

* cited by examiner

*Primary Examiner*—Frank Tsay
(74) *Attorney, Agent, or Firm*—Rosenthal & Osha L.L.P.

(57) ABSTRACT

A drill bit including a roller cone and fixed cutters positioned external to the roller cone and radially from the bit axis of rotation. The roller cone is located so that a drill diameter of the cone is substantially concentric with an axis of rotation of the bit. The fixed cutters can be made of tungsten carbide, polycrystalline diamond, boron nitride, or any other super-hard material. The fixed cutters are positioned to either maintain the hole diameter drilled by the roller cone or to drill a larger diameter hole than the hole drilled by the roller cone. The single roller cone may be located in the center of a multi-cone bit arrangement or in the center of a PDC bit to assist in drilling the center of a wellbore. The single roller cone may be used to form a bi-center bit in combination with a reaming section. The single roller cone may also be located on an independent sub that is removably attached to the bit body.

49 Claims, 7 Drawing Sheets

CENTERED-LEG ROLLER CONE DRILL BIT

BACKGROUND OF THE INVENTION

1. Technical Field

The invention relates generally to a single roller cone bit with radial cutting elements. More specifically, the invention relates to a single roller cone bit with cutting elements arranged radially about the axis of the drill bit such that the original gage of a wellbore may be maintained after the roller cone bit inserts are worn.

2. Background Art

The most commonly used roller cone bits in the well drilling industry include three roller cones attached to a drill bit body. The three roller cones act in concert to compressively crush the rock formation that is being penetrated by the bottom hole assembly. These three-cone bits are very popular in the industry and receive widespread use.

The "cones" of the three-cone bit include the body of the cone and a plurality of cutting elements, which can be teeth or inserts. The cutting elements are typically arranged in rows and may be manufactured in several different ways. In one method the cones and the teeth are milled from one parent block of hardened steel. Various hard-coatings can then be applied to the cutting elements and the wear surfaces of the cone to resist the wear encountered during drilling operations. In another method the cutting elements are hardened inserts that are attached to the base material of the cone. These inserts are generally composed of materials such as tungsten-carbide or polycrystalline diamond. The combination of the cone body and the cutting elements produce a cutting structure.

When three-cone bits are designed for use in small diameter wellbores, the drill bits must of course use smaller cones and smaller axial and radial support structures. As the scale of a roller cone is reduced, the size of the radial bearing used to absorb radial loads generated during drilling operations is reduced as well. The smaller radial bearings have less load-bearing capacity and can wear quickly when exposed to high axial loading.

Another type of roller cone bit, the single cone bit, has proven useful when drilling small diameter wellbores. These bits use a single roller cone attached to a drill bit body generally so that the cone's drill diameter is concentric with the axis of the bit. Single roller cone bits may use a significantly larger radial bearing for the same bit diameter as a comparable three roller cone bit. The larger radial bearing enables the use of higher bit loads and may enable increases in the rate of penetration ("ROP") of the drill bit as a result. The single cone bit typically has a hemispherical shape and drills out a "bowl" shaped bottom hole geometry.

Drill bits are rotated about an axis substantially parallel to the wellbore axis during drilling operations. The structure of the three-cone bit is such that the portions of the bit cones located nearest the center of the wellbore have linear velocities approaching zero. Therefore, the drilling efficiency of the three-cone bit at the center of the wellbore is low. The single roller bit, on the other hand, drills the center of the hole very efficiently. The structure of the single cone bit places a large portion of the cutting structure in moving contact with the formation at the center of the hole.

Moreover, the single cone bit tends to shear the formation below a reference plane that defines the top of the "bowl" shaped hole bottom. The shearing action, as opposed to the substantially compressive drilling action of three-cone bits, efficiently removes material from the formation at the center of the hole.

One of the limitations of single cone bits is that the cutting teeth or inserts used in the cone body tend to wear over time due to the shearing action. This tendency has been alleviated somewhat through the use of modern wear-resistant materials. The wear on the cutting structure does not appear to dramatically affect the ROP of the bottom hole assembly. However, as the cutting structure wears, the drilled diameter of the wellbore can be affected. As the cutting structure continues to wear, eventually the diameter of the wellbore will be reduced substantially. The reduction in wellbore diameter can be an intolerable condition and may require reaming with subsequent bits or the use of reamers or other devices designed to enlarge the wellbore diameter. Moreover, the reduced wellbore diameter will decrease the flow area available for the proper circulation of drilling fluids and bit cuttings. The use of bits, reamers, or other devices to ream the wellbore can incur substantial cost if the bottom hole assembly must be tripped in and out of the hole several times to complete the procedure.

Several types of single roller cone bits have been designed to maintain the diameter of the wellbore in the presence of worn bit inserts. For example, U.S. Pat. Nos. 2,119,618, 2,151,544, and 2,151,545 to Zublin disclose a composite single cone bit with roller reamers located above a bit structure containing a plurality of rotatable cutters. The roller reamers are designed to stabilize the bit in the bore hole. The Zublin invention, shown in prior art FIG. 1, uses the roller reamers to hold the bit to one side of the wellbore so that the rotating cutters are held in contact with the formation. Moreover, the roller reamers are designed to prevent excess wear on the shank that holds the rotating cutter support structure. The roller reamers also serve to absorb bit side force and, alternatively, to change the final diameter of the bore.

U.S. Pat. No. 4,140,189 to Garner discloses a rock bit with rolling cones and diamond cutters protruding from the periphery of the bit. The diamond cutters, mounted on carbide slugs, maintain the desired hole diameter when the bit is rotating.

U.S. Pat. No. 2,335,929 to Fortune discloses a roller bit that has two roller reamers located near a conical roller cutter. The roller reamers and the conical roller maintain a three point contact arrangement in the bottom of the wellbore and serve to stabilize the operation of the bit. The roller reamers serve to prevent the bit from "gyrating" within the wellbore.

Other prior art, including U.S. Pat. No. 1,322,540 to Chapman and U.S. Pat. No. 3,429,390 to Bennett disclose rollers or stand-off members for centering the drill bit within the wellbore. U.S. Pat. No. 3,424,258 to Nakayama discloses a rotary bit with scraping elements that guide the bit and produce a raised core of rock that is then drilled by the rotary member. The purpose for forming the raised core is to eliminate bit-tracking problems produced when the bit shifts radially within the wellbore.

SUMMARY OF THE INVENTION

One aspect of the invention is a drill bit that includes a roller cone and fixed cutters. The roller cone is positioned so that the drill diameter of the cone is substantially concentric with an axis of rotation of the bit, and the fixed cutters are positioned externally to the cone at a selected radius from the axis of the bit.

Another aspect of the invention is a drill bit that includes roller cones arranged circumferentially about an axis of rotation of the bit. A single roller cone is arranged so that its drill diameter is substantially concentric with the bit axis.

Another aspect of the invention is a bit that includes a bit body, a single roller cone, blades, and cutters mounted on the blades. The single roller cone is located so that its drill diameter is substantially concentric with the bit body while the blades are arranged circumferentially about the center of the bit body.

Another aspect of the invention is a bi-center bit that includes a roller cone, reaming blades, and fixed cutters located on the reaming blades. The roller cone is positioned so that the drill diameter of the cone is substantially concentric with an axis of rotation of the bit. The reaming blades and cutters are radially positioned to drill a larger diameter hole than the pass through diameter of the bit.

DETAILED DESCRIPTION

Figure 1:
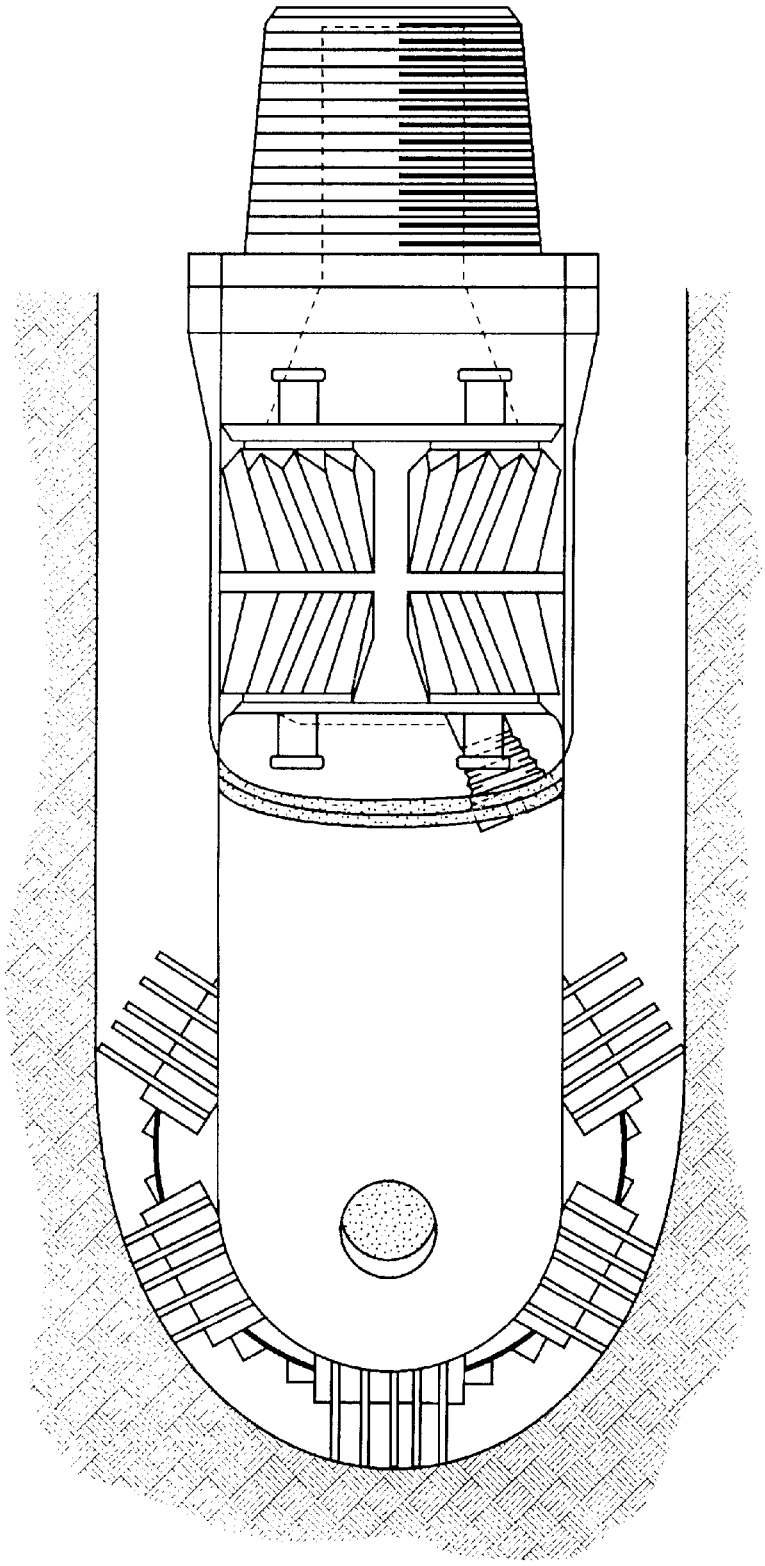
FIG. 1 (Prior Art)
FIG. 1 shows a prior art single roller cone bit.
Figure 2:
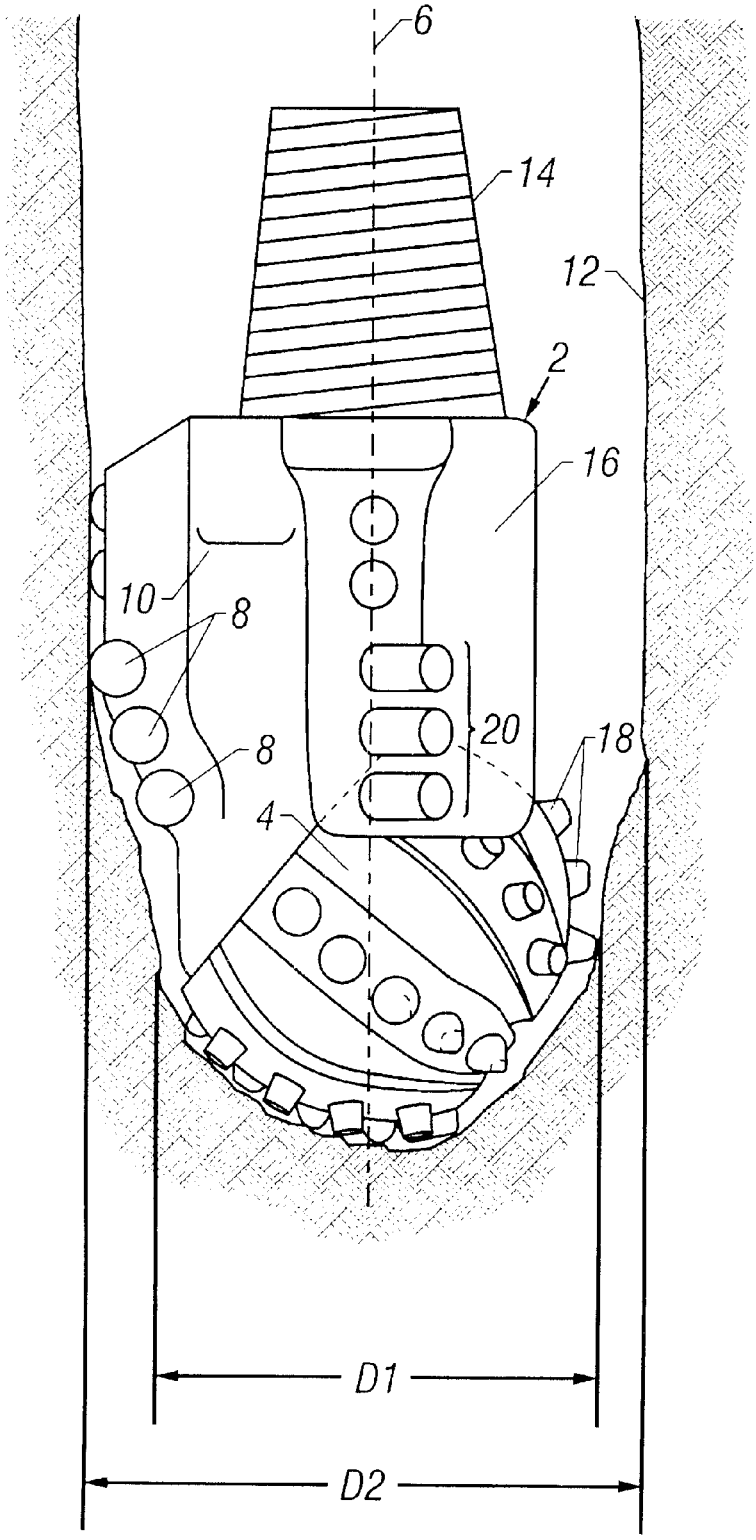
FIG. 2 shows a side view of an embodiment of the invention having overgage cutters located above the roller cone.

One embodiment of the invention as shown in FIG. 2 is a drill bit 2 that includes a roller cone 4 and a fixed cutter 8. The drill bit 2 includes a substantially cylindrical drill bit body 16 and a tapered, threaded connection 14 that joins the bit 2 to a bottom hole assembly (not shown) used to drill a wellbore 12. The body 16 and threaded connection 14 are structures known in the art and may differ in appearance and manner of construction from those shown in FIG. 2. The bit 2 rotates about an axis of rotation 6. The axis 6 is shown to be substantially centered within the wellbore 12.

The embodiment in FIG. 2 includes a single roller cone 4. The roller cone 4 shown is substantially hemispherical in shape. However, other shapes including conical or cylindrical configurations are acceptable and will perform the essential function of the invention. The roller cone 4 is shown to be arranged to have an axis of rotation at an angle oblique to the axis 6 of the wellbore 12. The exact angle is not a limitation of the invention. The roller cone 4 is rotatably attached to the bit body 16 by means known in the art. See U.S. Pat. No. 2,151,544 to Zublin for an example. The roller cone 4 is arranged to rotate about the bit axis 6 so that a drill diameter of the cone 4 is substantially concentric with the axis 6.

The cone 4 contains cutting elements 18. The cutting elements 18 may be formed from the base material of the cone 4 and coated with hard surfacing material including, for example, tungsten carbide compositions applied in a welding process. The cutting elements 18 may also be tungsten carbide, boron nitride, polycrystalline diamond, or other superhard inserts that are bonded to the cone 4.

The bit 2 also includes one or more fixed cutters 8 separate from roller cone 4. FIG. 2 shows the fixed cutters 8 located at axial positions above the roller cone 4. Furthermore, the fixed cutters 8 are radially located such that when the bit 2 rotates about axis 6, the trajectory defined by the fixed cutters 8 results in a hole having a diameter D2 greater than the diameter D1 drilled by the roller cone 4. The fixed cutters 8 arranged in this manner drill a gage wellbore 12 and maintain that diameter substantially irrespective of wear experienced by the cutting elements 18. Therefore, the action of the fixed cutters 8 ensures that the gage diameter D2 of the wellbore 12 will be maintained throughout the life of the drill bit 2, even when the cutting elements 18 begin to wear and would ordinarily produce an undergage wellbore if used alone. The fixed cutters 8 are shaped to actively cut through the formation rather than to merely protect the body 16 from wear. Fixed cutters having such shape are known in the art and are shown, for example, in U.S. Pat. No. 5,363,932 issued to Azar.

The fixed cutters 8 may be formed from different materials. For example, the fixed cutters 8 may be made from tungsten carbide. The fixed cutters 8 are preferably made with polycrystalline diamond, boron nitride, or any other superhard material. Moreover, the fixed cutters 8 may be formed from the base material of the bit body 16 and coated with a wear-resistant material such as tungsten carbide and may have a table of superhard material bonded thereto. Other types of cutters and hardfacing material may be used within the scope of the invention.

Although FIG. 2 shows more than one fixed cutter 8 used in the bit of this embodiment, any number of fixed cutters 8 may be used as well. FIG. 2 shows the fixed cutters 8 located on a blade 20. More than one such blade 20 may be located symmetrically about the circumference of the bit 2. The blades 20 may also be located about the circumference of the bit 2 in an asymmetric manner. Other blade groupings are acceptable and are within the scope of the invention.

Figure 3:
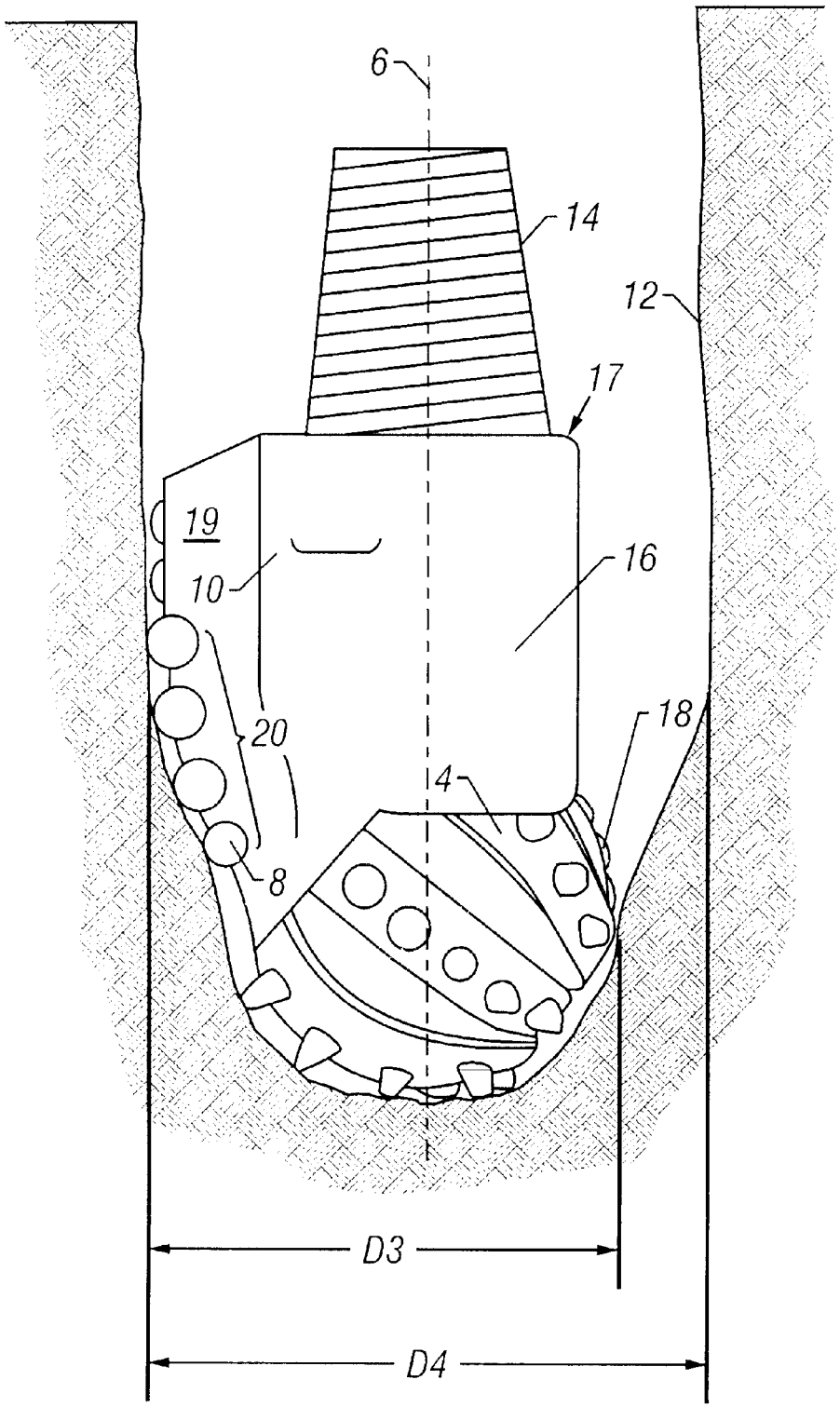
FIG. 3 shows a side view of an embodiment of the invention where the cutters are arranged to form a bi-center bit.

A particular asymmetric arrangement, shown in FIG. 3, has at least one blade 20 located on one side of the bit body 16. The blade 20, arranged in this manner, forms a bi-center drill bit in combination with the roller cone 4. The bi-center bit 17 may drill a hole 12 with a substantially larger diameter D4 than a pass through diameter D3. The pass through diameter D3 is defined as the smallest diameter opening through which the bit 17 may easily pass. Thus, the bit 17 may be passed through small diameter casing or a small diameter wellbore and then drill out a larger wellbore D4 below. When drilling with the bi-center bit 17, the single roller cone 4 serves as a pilot bit for a reaming section 19 defined by the blade 20.

A bi-center bit according to this aspect of the invention is not limited to a reaming section 19 as shown in FIG. 3. For example, the reaming section 19 may include multiple blades as shown in co-pending U.S. patent application 09/345,688, filed on Jun. 30, 1999, and assigned to the assignee of this invention. Another example of a reaming section is shown in U.S. Pat. No. 5,678,644 issued to Fielder.

Figure 7:
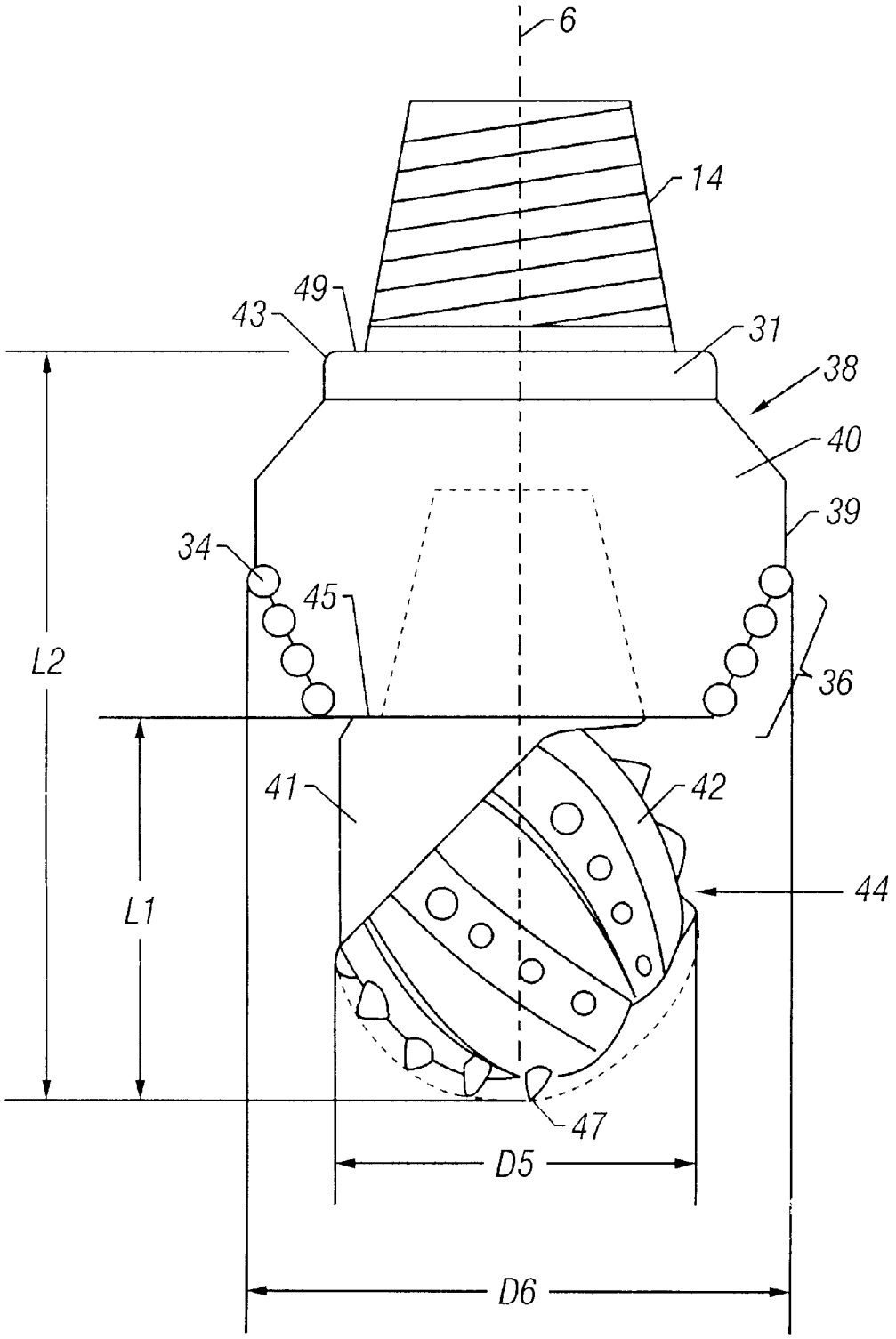
FIG. 7 shows a perspective view of an embodiment of the invention having cutters located on a sub positioned above a single roller cone with a drill diameter located substantially concentric with the axis of rotation.

Another bit (such as the bit shown in FIG. 7) has a single roller cone 42 threadedly attached to a sub 43 comprising a reaming section 39 in a multiple piece construction. The reaming section 39 may be either symmetric or asymmetric about the axis of rotation 6 of the bit 38. In the asymmetric arrangement, the single roller cone 42 acts as a pilot bit 38. The combination of the single roller cone pilot bit 38 and the asymmetric reamer sub 43 can function as a bi-center bit that has all of the capabilities of the bi-centered bits described above. FIG. 7 shows a symmetric reaming section 39, but the general construction applies to bi-center bits as well.

Nozzles (not shown) may be located on the bit 2 to provide flow of drilling fluid to clean the cutting surfaces and to provide circulation within the wellbore 12. Boss 10 indicates one possible nozzle location. Other nozzle locations are not shown in the Figures but are acceptable and desirable to increase the efficiency of the drilling operation. Placement of nozzles for cleaning and to increase drilling efficiency is well known in the art.

Figure 4:
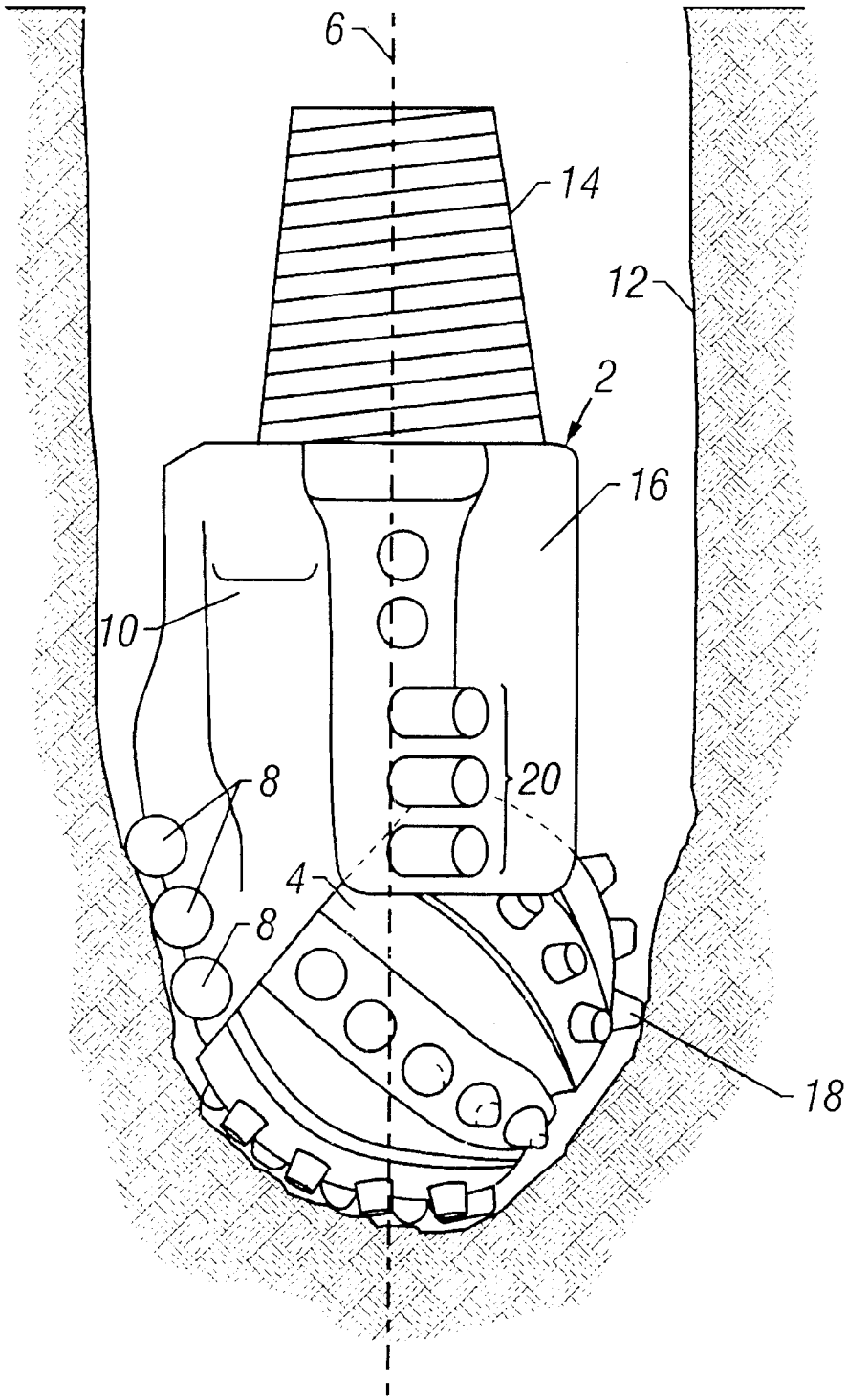
FIG. 4 shows a side view of an embodiment of the invention having overgage cutters located proximate the roller cone.

An embodiment of the invention shown in FIG. 4 includes fixed cutters 8 that are axially located proximate the roller cone 4. The fixed cutters 8 are shown to be arranged on blades 20 and are radially located such that rotation of the bit 2 about axis 6 will produce an overgage wellbore 12.

Figure 5:
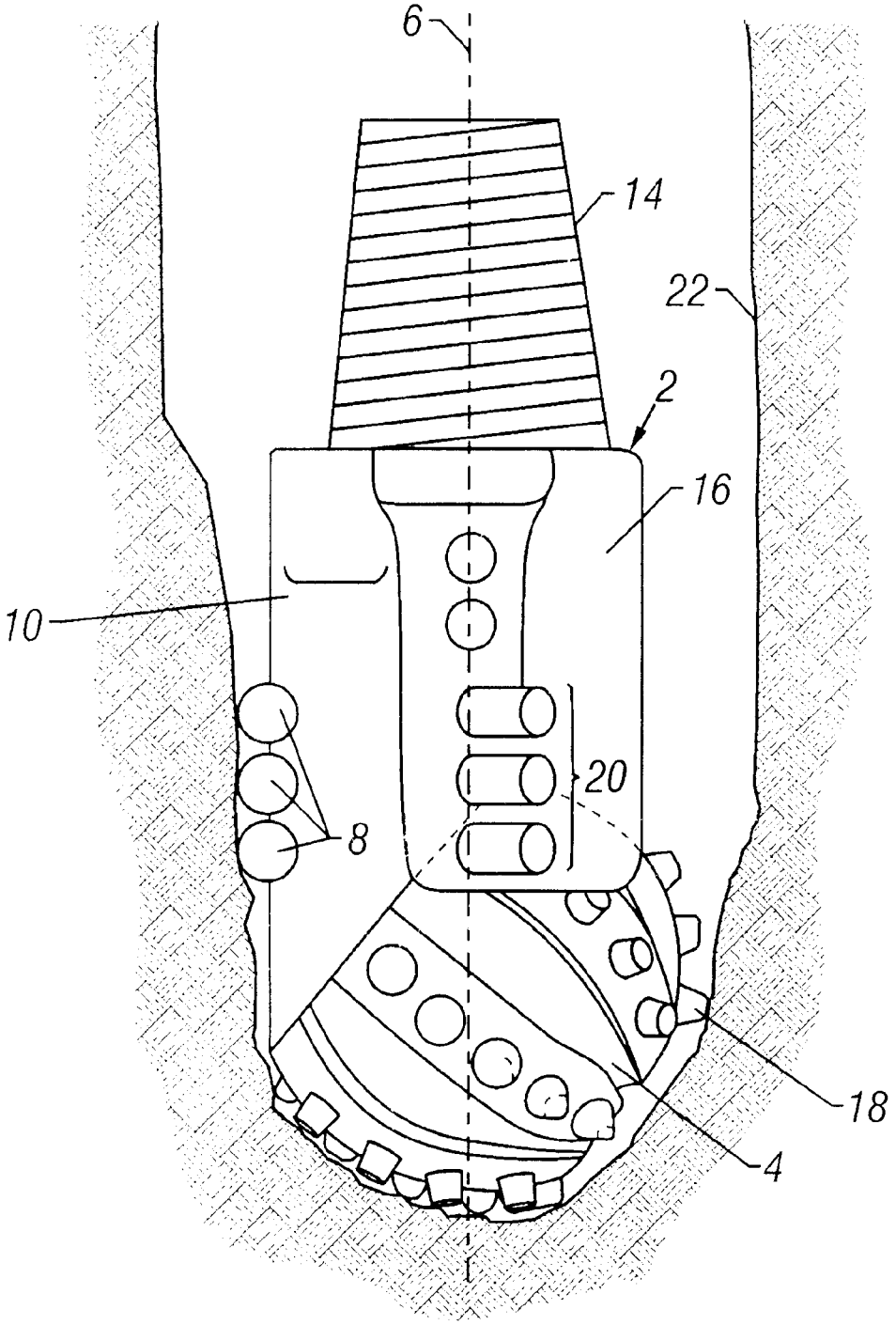
FIG. 5 shows a side view of an embodiment of the invention having gage cutters located above the roller cone.

An embodiment of the invention shown in FIG. 5 includes fixed cutters 8 that are axially located above roller cone 4. The fixed cutters 8 are arranged on blades 20 and are radially located such that rotation of the bit 2 about axis 6 will produce a gage wellbore 22. Thus, the wellbore diameter produced by the fixed cutters 8 is substantially the same as the wellbore diameter produced by undamaged and unworn elements 18 on the roller cone 4 as the bit 2 rotates about axis 6. This configuration produces a drill bit 2 that maintains the bit gage diameter throughout the useful life of the bit, substantially irrespective of wear of the cutting elements 18 on the cone 4. In addition to the previous two embodiments, another embodiment of the invention (not shown in the Figures) includes fixed cutters 8 that are located axially below the roller cone 4.

Figure 6:
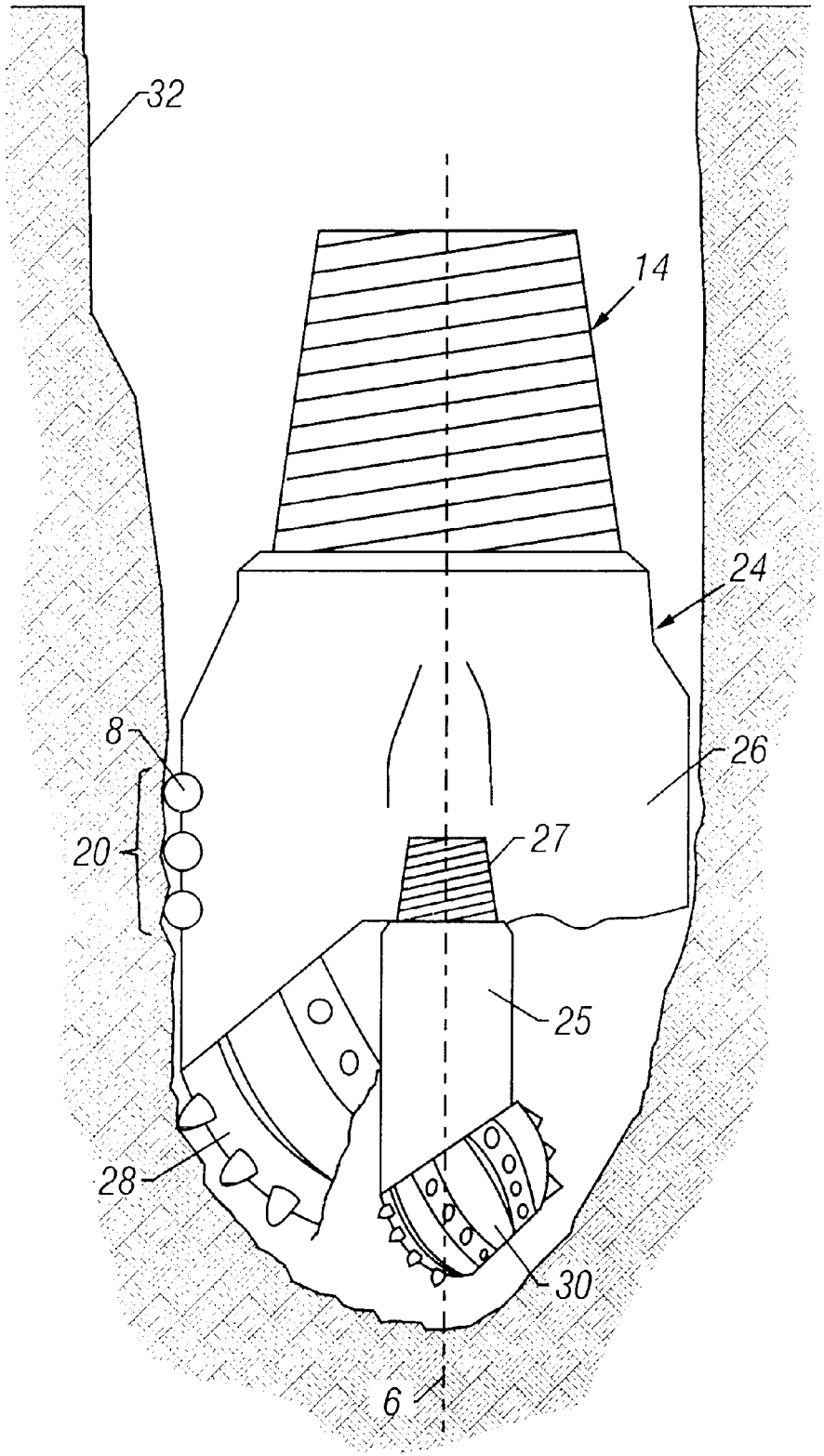
FIG. 6 shows a side view of an embodiment of the invention having a three-cone bit and a single roller cone with a drill diameter substantially concentric with the axis of rotation.

Another embodiment of the invention is shown in FIG. 6. This embodiment includes a combination bit 24 that includes a bit body 26 and three circumferential cones 28 that form a structure similar to a three-cone bit such as those known in the art. However, the invention may include more or fewer cones 28, as long as at least one cone 28 is present in the embodiment. The bit 24 also includes a single center cone 30 with a drill diameter substantially concentric with an axis of rotation 6 of the bit 24. The three circumferential cones 28 are arranged circumferentially about the center of the bit body 26 and about bit axis of rotation 6.

The circumferential cones 28 define the wellbore gage as they rotate about axis 6. The circumferential cones 28 may be any other shape known in the art to efficiently drill a wellbore (not shown). The circumferential cones 28 may be arranged at angles oblique to the wellbore or may be positioned in any other manner known in the art. The circumferential cones 28 are rotatably attached to the bit body 26 by means known in the art.

The center cone 30 may be positioned to have an axis of rotation oblique to the axis of rotation 6 of the bit. The center cone 30 is shown to be substantially hemispherical in shape. However, other shapes including more conical configurations are acceptable and will perform according to the invention. Moreover, the center cone 30 may be rotatably attached to the bit body 26 by means known in the art. However, FIG. 6 shows that the center cone 30 may also be removably attached to the bit body 26. For example, the center cone 30 may be attached to a separate, independent journal 25 that is threadedly connected 27 to the bit body 26.

The center cone 30 may be axially located below the circumferential cones 28 such that the center cone 30 first contacts the bottom of a flat wellbore 32. The center cone 30 may also be axially located above or substantially in line with the circumferential cones 28. The center cone 30 is arranged to efficiently drill the center of the wellbore because the linear velocity of the center cone 30 at the center of the wellbore 32 is substantially greater than that of conventional circumferential cone bits, thus leading to more efficient drilling. In contrast, the center-hole linear velocities of the cones of a traditional three-cone bit approach zero at the center of the wellbore. Velocities near zero at the center of the wellbore produce inefficient drilling and lead to the formation of a "cone" of rock at the center of the wellbore. The center cone 30 acts to drill this cone of rock.

FIG. 6 shows fixed cutters 8 that are positioned in a manner similar to that shown in FIG. 4. The fixed cutters 8 are arranged on blades 20 and are radially located such that rotation of the bit 24 about axis 6 will produce a gage wellbore (not shown). Thus, the gage diameter produced by the fixed cutters 8 is the same as the gage diameter produced by the rotation of roller cones 28 about axis 6. This configuration produces a drill bit 24 that substantially maintains the bit gage diameter throughout the useful life of the bit 24.

Another embodiment of the invention is shown in FIG. 7. The drill bit 38 shown in FIG. 7 includes a bit body 31 and a threaded connection 14. The bit 38 includes a center roller cone 42. The center cone 42 is located so that its drill diameter is substantially at the center of bit axis of rotation 6 and the wellbore (not shown) while blades 40 are arranged circumferentially about the center of the bit body 31 and the bit axis 6.

The blades 40 define the wellbore gage as they rotate about the axis 6. The blades 40 may be formed into any shape known in the art. The blades 40 may be formed integrally with the bit body 31 or attached to the body 31 by any means known in the art. The blades 40 include cutters 34 that may be made of polycrystalline diamond, tungsten carbide, boron nitride, or any other superhard material known in the art.

The center cone 42 is generally positioned to have an axis of rotation oblique to the axis of rotation 6 of the bit 38. The center cone 42 is shown to be substantially hemispherical in shape. However, other shapes including conical or cylindrical configurations are acceptable. Moreover, the center cone 42 may be permanently rotatably attached to the bit body 31 by means known in the art.

A journal 41 on which the center cone 42 is mounted may also be threaded into the body 31 of the bit 38, as shown in FIG. 7, to form a multiple piece construction. The configuration shown in FIG. 7 is similar to a bit with a close proximity reaming sub. The center cone 42 may be located at any selected distance L1 from the bit body 31 such that the center cone 42 may act as a pilot bit 44. For example, in one embodiment of the invention the selected distance L1, where L1 is measured from an end of the bit 47 to a make up shoulder 45 of the journal 41, is no more than about 25 percent of a distance L2, where L2 is measured from the end of the bit 47 to a make up shoulder 49 of the bit body 31. In this configuration, the multiple piece construction may be used to drill or ream a hole with diameter D6 that is substantially concentric with the hole diameter D5 drilled by the center cone 42. Moreover, as previously explained, the bit 38 may be arranged so that the center cone 42 acts as a pilot bit 44 for a bi-center bit wherein the bit 38 is arranged to ream the hole to achieve a final gage diameter that is substantially greater than the hole diameter produced by the center cone 42 alone but has a pass through diameter that is less than the drill diameter D6.

The center cone 42 may be axially located below the blades 40 such that the center cone 42 first contacts the bottom of a flat wellbore. The center cone 42 may also be axially located above or substantially in line with a lower surface of the blades 40. The center cone 42 is arranged to efficiently drill the center of the wellbore because the linear velocity of the single cone 42 at the center of the wellbore is non-zero. In contrast, the center-hole linear velocities of the blades 40 approach zero at the center of the wellbore. Velocities near zero at the center of the wellbore produce inefficient drilling and can lead to the formation of a "cone" of rock at the center of the wellbore. The center cone 42 may efficiently remove this formation and also serve to drill a pilot hole for the bit 38 if the center cone 42 is located below the blades 40.

The embodiments of the invention present several possible advantages when drilling a wellbore. One advantage is that the fixed cutters on the circumference of the bit ensure that the gage of the wellbore will be maintained throughout the useful life of the drill bit. Even if the cutting elements on the roller cone wear down, the fixed cutters will drill the formation at or above the gage defined by the rotation of the roller cones about the wellbore axis. This prolongs the useful life of the bit and reduces the number of trips required to drill a completed wellbore.

Another advantage relates to the ability of the invention to underream a wellbore. The invention may be modified so that the asymmetric arrangement of the cutters forms a bi-center arrangement. When operating in this manner, the cutters of the invention may drill a wellbore with a gage substantially greater than the gage defined by the roller cone alone.

While the invention has been described with respect to a limited number of embodiments, those skilled in the art will appreciate numerous variations therefrom without departing from the spirit and scope of the invention.

What is claimed is:

1. A bit comprising:

a roller cone affixed to a bit body so that a drill diameter of the cone is substantially concentric with an axis of rotation of the bit; and fixed cutters disposed on the bit body radially from the axis at a drill radius selected to drill a hole having a larger diameter than a hole drilled by the roller cone wherein the cutters are external to the roller cone.

2. The bit of claim 1 wherein the fixed cutters comprise tungsten carbide cutters.

3. The bit of claim 1 wherein the fixed cutters comprise boron nitride cutters.

4. The bit of claim 1 wherein the fixed cutters comprise PDC cutters.

5. The bit of claim 1 wherein the fixed cutters are axially located proximate the roller cone.

6. The bit of claim 1 wherein the fixed cutters are axially located above the roller cone.

7. The bit of claim 1 wherein the fixed cutters are radially positioned to drill substantially the same diameter hole as a hole drilled by the roller cone.

8. The bit of claim 1 wherein the fixed cutters are radially positioned to define a pass through diameter smaller than a drill diameter of the bit.

9. The bit of claim 1 wherein the fixed cutters are substantially arranged on at least one blade proximal to the cone.

10. The bit of claim 1 wherein the roller cone is substantially hemispherical in shape.

11. The bit of claim 1 wherein the roller cone is disposed on an independent sub that is removably attached to the bit body.

12. The bit of claim 11 wherein the roller cone is axially positioned so that a distance from a lower end of the roller cone to a make up shoulder of the independent sub is less than about 25 percent of a distance from the lower end of the roller cone to a make up shoulder of the bit body.

13. A bit comprising:

at least one roller cone affixed to a bit body and arranged circumferentially about an axis of rotation of the bit; and a single roller cone affixed to the bit body so that a drill diameter of the single roller cone is substantially concentric with an axis of rotation of the bit.

14. The bit of claim 13 wherein the single roller cone extends axially below the at least one circumferential roller cone.

15. The bit of claim 13 wherein the single roller cone is substantially axially in line with the at least one circumferential roller cone.

16. The bit of claim 13 wherein the single roller cone is disposed on an independent sub that is removably attached to the bit body.

17. The bit of claim 16 wherein the single roller cone is axially positioned so that a distance from a lower end of the single roller cone to a make up shoulder of the independent sub is less than about 25 percent of a distance from the lower end of the single roller cone to a make up shoulder of the bit body.

18. The bit of claim 13 wherein at least one fixed cutter is disposed on the bit body radially from the axis at a selected drill radius of the bit wherein the at least one fixed cutter is external to the single roller cone and the at least one circumferential roller cone.

19. The bit of claim 18 wherein the at least one fixed cutter comprises a tungsten carbide cutter.

20. The bit of claim 18 wherein the at least one fixed cutter comprises a boron nitride cutter.

21. The bit of claim 18 wherein the at least one fixed cutter comprises a PDC cutter.

22. The bit of claim 18 wherein the at least one fixed cutter is axially located proximate the at least one circumferential roller cone.

23. The bit of claim 18 wherein the at least one fixed cutter is axially located above the at least one circumferential roller cone.

24. The bit of claim 18 wherein the at least one fixed cutter is radially positioned to drill substantially the same diameter hole as a hole drilled by the roller cones.

25. The bit of claim 18 wherein the at least one fixed cutter is radially positioned to drill a larger diameter hole than a hole drilled by the roller cones.

26. The bit of claim 18 wherein the single roller cone is disposed on an independent sub that is removably attached to the bit body.

27. The bit of claim 26 wherein the single roller cone is axially positioned so that a distance from a lower end of the single roller cone to a make up shoulder of the independent sub is less than about 25 percent of a distance from the lower end of the single roller cone to a make up shoulder of the bit body.

28. A bi-center bit comprising:

a roller cone affixed to a bit body so that a drill diameter of the cone is substantially concentric with an axis of rotation of the bit;

at least one reaming blade disposed on the bit body; and fixed cutters disposed on the reaming blade and radially from the axis at a selected drill radius of the bit, wherein the cutters are external to the roller cone, the reaming blade defining a pass through diameter smaller than a drill diameter of the bit.

29. The bit of claim 28 wherein the roller cone serves as a pilot section for the bi-center bit.

30. The bit of claim 28 wherein the fixed cutters comprise tungsten carbide cutters.

31. The bit of claim 28 wherein the fixed cutters comprise boron nitride cutters.

32. The bit of claim 28 wherein the fixed cutters comprise PDC cutters.

33. The bit of claim 28 wherein the roller cone is substantially hemispherical in shape.

34. The bit of claim 28 wherein nozzles are disposed on the body proximate the roller cone and cutters to provide drilling fluid to assist in cleaning.

35. The bit of claim 28 wherein the roller cone is disposed on an independent sub that is removably attached to the bit body.

36. The bit of claim 35 wherein the roller cone is axially positioned so that a distance from a lower end of the roller cone to a make up shoulder of the independent sub is less than about 25 percent of a distance from the lower end of the roller cone to a make up shoulder of the bit body.

37. A bit comprising:

at least one roller cone affixed to a bit body and arranged circumferentially about an axis of rotation of the bit;

a single roller cone affixed to the bit body so that a drill diameter of the single roller cone is substantially concentric with an axis of rotation of the bit; and at least one fixed cutter disposed on the bit body radially from the axis at a selected drill radius of the bit wherein the at least one fixed cutter is external to the single roller cone and the at least one circumferential roller cone.

38. The bit of claim 37 wherein the single roller cone extends axially below the at least one circumferential roller cone.

39. The bit of claim 37 wherein the single roller cone is substantially axially in line with the at least one circumferential roller cone.

40. The bit of claim 37 wherein the single roller cone is disposed on an independent sub that is removably attached to the bit body.

41. The bit of claim 40 wherein the single roller cone is axially positioned so that a distance from a lower end of the single roller cone to a make up shoulder of the independent sub is less than about 25 percent of a distance from the lower end of the single roller cone to a make up shoulder of the bit body.

42. The bit of claim 37 wherein the at least one fixed cutter comprises a tungsten carbide cutter.

43. The bit of claim 37 wherein the at least one fixed cutter comprises a boron nitride cutter.

44. The bit of claim 37 wherein the at least one fixed cutter comprises a PDC cutter.

45. The bit of claim 37 wherein the at least one fixed cutter is axially located proximate the at least one circumferential roller cone.

46. The bit of claim 37 wherein the at least one fixed cutter is axially located above the at least one circumferential roller cone.

47. The bit of claim 37 wherein the at least one fixed cutter is radially positioned to drill substantially the same diameter hole as a hole drilled by the roller cones.

48. The bit of claim 37 wherein the at least one fixed cutter is radially positioned to drill a larger diameter hole than a hole drilled by the roller cones.

49. The bit of claim 37 wherein the single roller cone is axially positioned so that a distance from a lower end of the single roller cone to a make up shoulder of the independent sub is less than about 25 percent of a distance from the lower end of the single roller cone to a make up shoulder of the bit body.

* * * * *